US006422921B1

(12) United States Patent
Ettinger

(10) Patent No.: US 6,422,921 B1
(45) Date of Patent: Jul. 23, 2002

(54) HEAT ACTIVATED DETACHABLE POLISHING PAD

(75) Inventor: Gary C. Ettinger, Los Altos, CA (US)

(73) Assignee: Applied Materials, Inc., Santa Clara, CA (US)

( * ) Notice: Subject to any disclaimer, the term of this patent is extended or adjusted under 35 U.S.C. 154(b) by 0 days.

(21) Appl. No.: 09/422,898

(22) Filed: Oct. 22, 1999

(51) Int. Cl.[7] ..... B24B 1/00
(52) U.S. Cl. ..... 451/41; 451/285; 451/287
(58) Field of Search ..... 451/287, 41, 42, 451/285, 286, 288, 289, 390, 520, 517, 7

(56) References Cited

U.S. PATENT DOCUMENTS

| | | | | |
|---|---|---|---|---|
| 5,152,917 A | | 10/1992 | Pieper et al. | |
| 5,183,402 A | | 2/1993 | Cooke et al. | |
| 5,342,419 A | | 8/1994 | Hibbard | |
| 5,365,619 A | | 11/1994 | Culler | |
| 5,378,251 A | | 1/1995 | Culler et al. | |
| 5,558,717 A | | 9/1996 | Zhao et al. | |
| 5,738,574 A | | 4/1998 | Tolles et al. | |
| 5,743,788 A | | 4/1998 | Vanell | |
| 5,791,975 A | * | 8/1998 | Cesna | 451/287 |
| 5,820,448 A | | 10/1998 | Shamouilian et al. | |
| 5,842,909 A | | 12/1998 | Sandhu et al. | |
| 5,871,392 A | | 2/1999 | Meikle et al. | |
| 6,033,293 A | * | 3/2000 | Crevasse | 451/285 |
| 6,036,586 A | * | 3/2000 | Ward | 451/287 |
| 6,045,439 A | * | 4/2000 | Birang | 451/287 |

* cited by examiner

*Primary Examiner*—Joseph J. Hail, III
*Assistant Examiner*—Daniel Shanley
(74) *Attorney, Agent, or Firm*—Moser, Patterson & Sheridan

(57) ABSTRACT

A polishing pad is adhered to a platen by a heat activated adhesive. Means are provided to heat the adhesive to a temperature sufficient to soften the adhesive, thereby facilitating removal of the polishing pad from the platen. Embodiments include employing a heat softenable adhesive that preferentially adheres to the polishing pad upon removal of the polishing pad from the platen.

37 Claims, 2 Drawing Sheets

HEAT ACTIVATED DETACHABLE POLISHING PAD

FIELD OF THE INVENTION

The present invention relates generally to an apparatus for planarizing a substrate surface and, more particularly, to a platen assembly containing a polishing pad. The present invention is applicable to manufacturing high speed integrated circuits with high production throughput.

BACKGROUND ART

Chemical-mechanical polishing (CMP) is a conventional method of planarizing a substrate. CMP is sensibly employed during the manufacture of semiconductor devices to obtain a uniform surface, and enjoys particular applicability in manufacturing semiconductor devices having submicron feature sizes, such that surface irregularities do not exceed the depth of focus limitations of conventional photolithographic devices.

In conventional CMP techniques, a wafer carrier assembly is rotated in contact with a polishing pad in a CMP apparatus. The polishing pad is mounted on a platen which can be rotated or linearly driven by an external driving force. The wafers are typically mounted on a carrier or polishing head which provides a controllable force, i.e., pressure urging the wafers against the moving polishing pad. The CMP apparatus effects polishing or rubbing movement between the surface of each thin semiconductor wafer and the polishing pad while dispensing a polishing slurry or chemical agent. Conventional polishing pads employed in abrasive slurry processing typically comprise a grooved porous polymeric surface, such as polyurethane, and the abrasive slurry varied in accordance with a particular material undergoing CMP. Fixed abrasive polishing pads comprise a polymeric backing sheet with a plurality of geometric abrasive composite elements adhered thereto. The abrasive elements typically comprise a plurality of abrasive particles in a binder, e.g., a polymeric binder. During CMP employing fixed abrasive articles, a chemical agent is dispersed to provide chemical activity, while mechanical activity is provided by the fixed abrasive elements.

Polishing pads, whether fixed abrasive or conventional grooved polishing pads employed in slurry abrasive processing, typically comprise a polymeric material and are adhered to a metallic platen, e.g., aluminum or stainless steel, by friction or by an adhesive, such as a pressure sensitive adhesive. Periodically, the polishing pads must be replaced. However, it is extremely difficult to remove a polishing pad from the underlying platen. Typically, a large amount of force is required to manually remove the polishing pad from the platen. The time and effort required to remove a polishing pad from a platen adversely impacts manufacturing throughput and, hence, constitutes a distinct disadvantage in the competitive semiconductor manufacturing marketplace.

Accordingly, there exists a need for a method of removing a polishing pad from a platen in an expeditious, efficient and cost effective manner.

DISCLOSURE OF THE INVENTION

An aspect of the present invention is a CMP apparatus comprising a platen and a polishing pad which is easily removable from the platen in a cost effective and efficient manner.

Another aspect of the present invention is a method of removing a polishing pad from a platen in a cost effective efficient manner.

Additional aspects and other features of the present invention will be set forth in the description which follows and in part will become apparent to those having ordinary skill in the art upon examination of the following will maybe learn from the practice of the present invention. The aspects of the present invention may be realized and obtained as particularly pointed out in the appended claims.

According to the present invention, the foregoing and other aspects are implemented in part by an apparatus for polishing a wafer, the apparatus comprising: a platen; a heat softenable adhesive on the platen, means for heating the heat softenable adhesive; and a polishing pad on the heat softenable adhesive.

Another aspect of the present invention is a method of planarizing a wafer, the method comprising: providing a polishing apparatus containing a platen and heating means; adhering a polishing pad to the platen with a heat softenable adhesive; and polishing of the wafer. Subsequently, the heat softenable adhesive is heated with a heating means to a temperature sufficient to soften the heat softenable adhesive and the polishing pad easily removed from the platen.

A further aspect of the present invention is a method of removing a polymeric polishing pad from a metal platen of a polishing apparatus, wherein the pad is adhered to the platen by a heat softenable adhesive, the method comprising heating the heat softenable adhesive to a temperature sufficient to soften the heat softenable adhesive and facilitate removal of the pad.

Embodiments of the present invention comprise forming the platen with internal heating means, such as a heating filament or channels through which a heated fluid is passed. Embodiments of the present invention further comprise employing a heat softenable adhesive which preferentially adheres to the polymeric polishing pad upon being softened by heating and removed from the metallic platen.

Additional aspects of the present invention will become readily apparent to those skilled in this art from the following detailed description, wherein embodiments of the present invention are described, simply by way of illustration of the best mode contemplated for carrying out the present invention. As will be realized, the present invention is capable of other and different embodiments, and its several details are capable of modifications in various obvious respects, all without the parting from the present invention. Accordingly, the drawings and description are to be regarded as illustrative in nature and not as restrictive.

DESCRIPTION OF THE INVENTION

The present invention provides a method for efficiently and rapidly removing a polishing pad from a platen to enhance CMP throughput. Conventional polishing pads are polymeric, while platens are conventionally metallic, such as aluminum or stainless steel. The polishing pads are typically tightly adhered to a platen, as by means of a pressure sensitive adhesive as disclosed by Shamouilian et al. in U.S. Pat. No. 5,820,448, or by means of friction. It is extremely difficult to efficiently remove a polishing pad from a platen of a conventional CMP apparatus.

The present invention enables the removal of a polishing pad from a platen in a cost efficient manner by adhering the polishing pad to the platen by means of a heat softenable adhesive. After CMP a plurality of wafers, the useful life of the polishing pad expires, requiring removal of the polishing pad from the platen. In accordance with embodiments of the present invention, the polishing pad is easily removed from the platen by elevating the temperature of the heat softenable adhesive to a temperature such that the heat softenable adhesive softens to a sufficient degree to facilitate removal of the polishing pad from the platen with a minimum amount of force. Given the objectives and guidance of the present invention, the particular adhesive employed can be selected for a given application, depending upon the particular metal of the platen and particular polymeric material of the polishing pad. For example, in employing an aluminum or stainless steel platen and a polyurethane pad, various thermoplastic adhesives can be employed. Suitable thermoplastic adhesives include those based on polyurethane, polyester, polyolefin and polyamide. These thermoplastics can be combined for more optimum bonding and release. Polyurethane adhesive UAF-420 available from Adhesive Films, Inc. located in Pine Brook, N.J., can be employed. A combination of a low melt and high melt polyurethane film can also be employed. A suitable laminated film is TAF-830, available from Adhesive Films, Inc. of Pine Brook, N.J. Embodiments of the present invention include extruding the thermoplastic adhesive onto the polishing pad at a thickness of about 0.001 to about 0.030 inch, e.g.; about 0.003 inch.

Embodiments of the present invention also include coating the platen to facilitate preferential adhesion of the thermoplastic to the polishing pad vis-à-vis the platen. The use of a coating on the platen in this way prevents leaving adhesive residue on the platen when removing the pad. A suitable platen coating for this purpose comprises a fluoropolymer such as Ausimont Halar ECTFE available from Ausimont, USA located in Thorofare, N.J. The platen coating can be applied at a suitable thickness, e.g., about 0.101 inch to about 0.105 inch.

Figure 1:
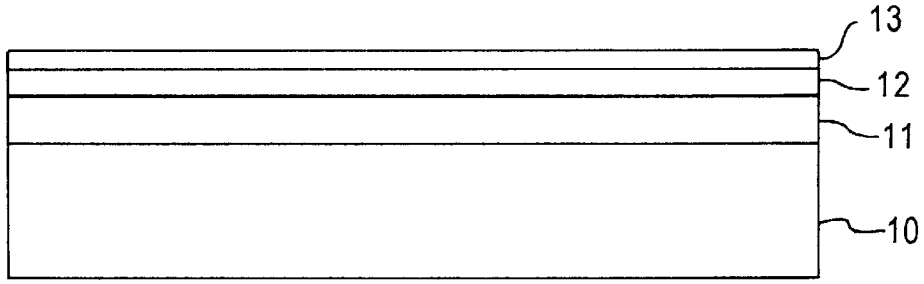
FIG. 1 schematically illustrates an embodiment of the present invention.

An embodiment of the present invention is schematically illustrated in FIG. 1 and comprises a platen assembly that includes metallic platen 10, heating element 11, which can be on or within platen 10, heat activatable or softenable adhesive layer 12 and polymeric polishing pad 13, such as a fixed abrasive polishing pad or a conventional polishing pad for use with an abrasive containing slurry.

Figure 2:
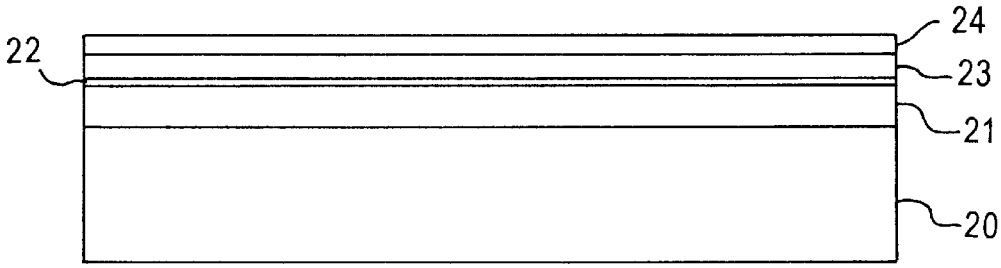
FIG. 2 schematically illustrates another embodiment of a platen assembly in accordance with the present invention.

Another embodiment of the present invention is illustrated in FIG. 2 and comprises metallic platen 20, heating element 21 on or within platen 20, heat activatable or softenable primer layer 22 adhered to the upper surface of the heating element 21 or upper portion of the platen 20 containing heating element 21 therein, adhesive layer 23 and polishing pad 24 bonded to adhesive layer 23.

Figure 3:
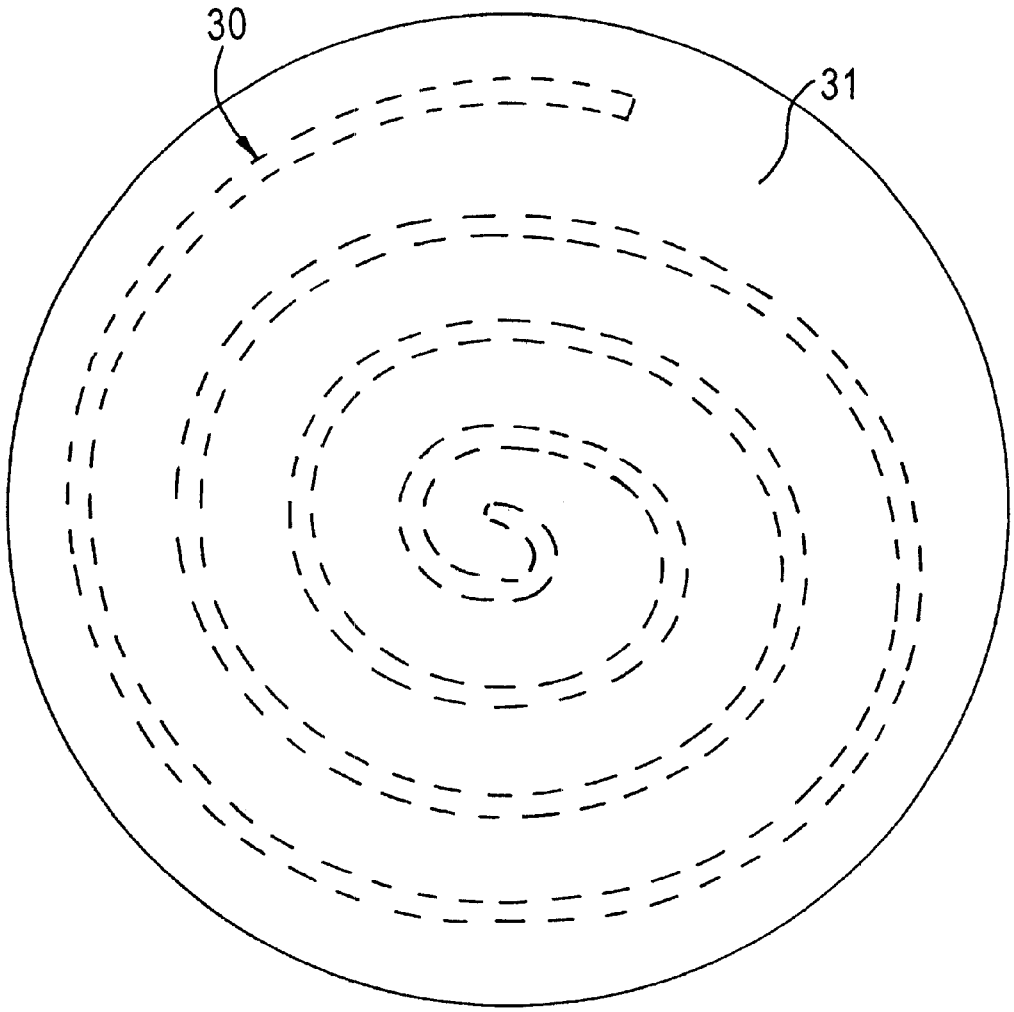
FIG. 3 schematically illustrates a platen containing a heating filament in accordance with an embodiment of the present invention.

Heating of the heat activatable or heat softenable adhesive in accordance with embodiments of the present invention can be implemented in any conventional manner. For example, platen 10 can comprise channels through which a heated fluid, such as air or water, can be passed. In another embodiment, a heating filament, such as that disclosed by Sandhu et al. in U.S. Pat. No. 5,842,909 can be employed. Such an embodiment of a platen containing a heating filament is schematically illustrated in FIG. 3 and comprises a heating filament 30 embedded within platen 31, such as an upper surface thereof and indicated by reference numerals 11 and 21 in FIGS. 1 and 2, respectively. Heating filament 30 effectively heats platen 31 evenly, thereby elevating the temperature of the overlying heat softenable adhesive to a sufficient temperature, as about 120° F. to about 350° F., e.g., about 140° F. to about 180° F., to facilitate removal of the polishing pad from the platen with a minimum of force.

In alternative embodiments, a controllable heated liquid or gas is introduced into the interior of the platen to controllably heat the platen, as also disclosed in U.S. Pat. No. 5,842,909. It should be understood that any type of heater can be used to implement the present invention.

Figure 4:
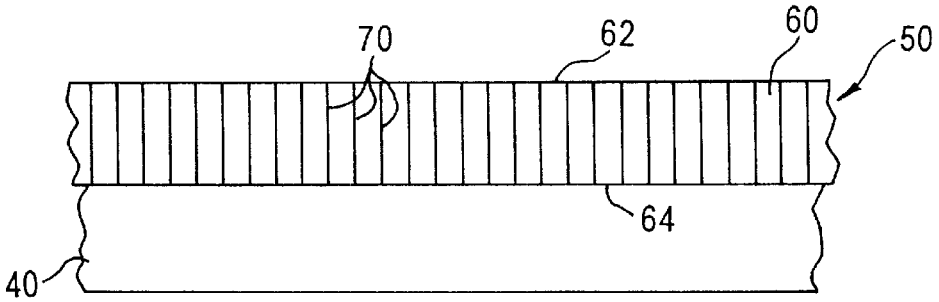
FIG. 4 schematically illustrates a conductive underpad in accordance with another embodiment of the present invention.

In another embodiment of the present invention, a deformable conductive underpad is positioned on the platen. A suitable deformable conductive underpad is disclosed by Meikle et al. in U.S. Pat. No. 5,871,392. An embodiment of a deformable conductive underpad is schematically illustrated in FIG. 4 and comprises underpad 50 positioned on platen 40. Underpad 50 comprises a body portion 60 with the top surface 62 and bottom surface 64. Body portion 50 preferably comprises a continuous phase matrix material, such as polyurethane or Teflon®. A thermally conductive material, such as a plurality of thermal conductors 70, is positioned or mixed within a body portion 60. Thermal conductors 70 can comprise a material having a relatively high thermal conductivity of at least 0.5 W/m° K. Thermal conductors made from carbon fiber are particularly well suited to enhance thermal conductivity while providing adequate resilience and sufficient compressibility of the underpad 50. Thermal conductors 70 are preferably strands that extend from approximately the top face 62 through the bottom face 64 of body portion 60.

The present invention is applicable to any and various types of conventional CMP apparatuses containing fixed abrasive or conventional polishing pads, whether on rotatable platens or linearly moving belts or platens. The present invention increases CMP throughput by facilitating removal of a polishing pad from a platen with a minimum of force by employing a heat softenable adhesive to adhere the polishing pad to the platen for use during CMP and facilitate removal. Heating can be effected in any conventional manner as by the various embodiments disclosed herein, including the use of a conductive underpad, or metallic heating elements provided on or within the platen, as well as heating channels within the platen through which hot fluid is passed. The inventive concept of providing a heat softenable adhesive to facilitate removal of a polishing pad on a platen is not limited to any of the specific embodiments or materials disclosed herein, but enjoys wide applicability to any of the various types of polishing pads and platens. The present invention enjoys wide industrial applicability, particularly in planarizing substrates during manufacturing of highly integrated semi-conductive devices having device features in the deep submicron range size.

Only the preferred embodiment of the present invention and but a few examples of its versatility are shown and described in the present disclosure. It is to be understood that the present invention is capable of use in various other combinations and environments and is capable of changes and modifications within the scope of the inventive concept as expressed herein.

What is claimed is:

1. An apparatus for polishing a wafer, comprising:

a platen;

a heat softenable adhesive disposed on the platen;

means for heating the heat softenable adhesive; and a polishing pad disposed on the heat softenable adhesive.

2. The apparatus according to claim 1, wherein the means for heating the heat softenable adhesive comprises a compressible underpad containing thermally conductive material disposed between the platen and the polishing pad, and wherein the heat softenable adhesive is applied to the under pad.

3. The apparatus according to claim 1, wherein the means for heating the heat softenable adhesive is disposed within the platen.

4. The apparatus according to claim 3, wherein the means for heating the heat softenable adhesive comprises a heating filament disposed within the platen.

5. The apparatus according to claim 3, wherein the means for heating the heat softenable adhesive comprises channels disposed within the platen through which a hot fluid is passed.

6. An apparatus for polishing a wafer, comprising:

a platen;

a heat softenable adhesive disposed on the platen;

a heater for heating the heat softenable adhesive in thermal connection with the heat softenable adhesive; and a polishing pad disposed on the heat softenable adhesive.

7. The apparatus according to claim 6, wherein the heat softenable adhesive comprises a layer having a thickness of about 0.001 inch to about 0.030 inch.

8. The apparatus according to claim 6, wherein the heat softenable adhesive comprises a thermoplastic material.

9. The apparatus according to claim 8, wherein the thermoplastic material comprises a material selected from the group of polyurethane, polyester, polyolefin, polyamide, and combinations thereof.

10. The apparatus according to claim 6, wherein:

the polishing pad comprises a plastic material; and the platen comprises a metal.

11. The apparatus according to claim 10, wherein the heat softenable adhesive preferentially adheres to the polishing pad upon being softened by heating and removed from the platen.

12. The apparatus according to claim 11, further comprising an adhesive layer adhered to the polishing pad and to the heat softenable adhesive, wherein the heat softenable adhesive is applied as a primer layer to the platen at a thickness of about 0.0001 inch to about 0.001 inch.

13. The apparatus according to claim 11, further comprising a coating applied to the platen to facilitate preferential adhesion of the heat softenable adhesive to the polishing pad upon being softened by heating and removed from the platen.

14. The apparatus according to claim 13, wherein the coating comprises a fluoropolymer.

15. An article of manufacture for polishing a wafer, the article of manufacture comprising a polishing pad and a heat softenable adhesive disposed thereon.

16. The article of manufacture of claim 15, wherein the heat softenable adhesive is a layer having a thickness of about 0.001 inch to about 0.030 inch.

17. The article of manufacture of claim 15, wherein the heat softenable adhesive comprises a thermoplastic material.

18. The article of manufacture of claim 17, wherein the thermoplastic material is selected from the group of polyurethane, polyester, polyolefin, polyamide, and combinations thereof.

19. The article of manufacture of claim 17, wherein the thermoplastic material comprises polyurethane.

20. The article of manufacture of claim 15, wherein the heat softenable adhesive comprises a first polyurethane film having a first melt temperature and a second polyurethane film having a second melt temperature higher than the first melt temperature.

21. The article of manufacture of claim 15, wherein the polishing pad comprises a polymeric material.

22. The article of manufacture of claim 21, wherein the polymeric material comprises polyurethane.

23. The article of manufacture of claim 15, wherein the polishing pad comprises polyurethane and the heat softenable adhesive comprises polyurethane.

24. The article of manufacture of claim 15, wherein the heat softenable adhesive softens at a temperature between about 120° F. and about 350° F.

25. The article of manufacture of claim 15, wherein the heat softenable adhesive softens at a temperature between about 140° F. and about 180° F.

26. The article of manufacture of claim 15, wherein the heat softenable adhesive is laminated onto the polishing pad.

27. The article of manufacture of claim 15, wherein the heat softenable adhesive preferentially adheres to the polishing pad upon being softened by heating.

28. The article of manufacture of claim 15, wherein the polishing pad has a polishing surface and a bottom surface, and the heat softenable adhesive is disposed on the bottom surface.

29. The article of manufacture of claim 15, wherein the polishing pad has a polishing surface and a bottom surface, and the heat softenable adhesive is disposed on the bottom surface and contacts an upper surface of a platen.

30. An article of manufacture for polishing a wafer, the article of manufacture comprising a polishing pad and a heat softenable adhesive which softens at a temperature between about 120° F. and about 350° F., wherein the heat softenable adhesive comprises a first polyurethane film having a first melt temperature and a second polyurethane film having a second melt temperature higher than the first melt temperature.

31. The article of manufacture of claim 30, wherein the heat softenable adhesive having a thickness of about 0.001 inch to about 0.030 inch disposed on the polishing pad.

32. The article of manufacture of claim 31, wherein the heat softenable adhesive softens at a temperature between about 140° F. and about 180° F.

33. The article of manufacture of claim 31, wherein the heat softenable adhesive is laminated onto the polishing pad.

34. The article of manufacture of claim 30, wherein the heat softenable adhesive preferentially adheres to the polishing pad upon being softened by heating.

35. The article of manufacture of claim 30, wherein the polishing pad comprises polyurethane.

36. The article of manufacture of claim 30, wherein the polishing pad has a polishing surface and a bottom surface, and the heat softenable adhesive is disposed on the bottom surface.

37. The article of manufacture of claim 30, wherein the polishing pad has a polishing surface and a bottom surface, and the heat softenable adhesive is disposed on the bottom surface and contacts an upper surface of a platen.

* * * * *